US005941260A

United States Patent [19]

Wershe

[11] Patent Number: 5,941,260

[45] Date of Patent: Aug. 24, 1999

[54] BEARING CLEANING SYSTEM

[76] Inventor: Richard Wershe, 28020 Elba, St. Slair Shores, Mich. 48081

[21] Appl. No.: 08/890,348

[22] Filed: Jul. 9, 1997

Related U.S. Application Data

[60] Provisional application No. 60/021,708, Jul. 12, 1996.

[51] Int. Cl.[6] ..... B08B 3/04

[52] U.S. Cl. ..... 134/117; 134/182

[58] Field of Search ..... 134/116, 117, 134/182, 183; 206/205, 5.1

[56] References Cited

U.S. PATENT DOCUMENTS

| | | | |
|---|---|---|---|
| 2,652,843 | 9/1953 | Schuchman et al. | 134/116 |
| 2,823,682 | 2/1958 | Coulter | 134/116 X |
| 4,697,697 | 10/1987 | Graham et al. | 206/205 X |
| 4,782,941 | 11/1988 | Freise | 134/117 X |
| 5,678,582 | 10/1997 | McClure | 134/116 |

FOREIGN PATENT DOCUMENTS

| | | | |
|---|---|---|---|
| 714385 | 7/1965 | Canada | 206/205 |
| 511595 | 10/1971 | Switzerland | 134/117 |

*Primary Examiner*—Philip R. Coe
*Attorney, Agent, or Firm*—Reising, Ethington, Barnes, Kisselle, et al

[57] ABSTRACT

A bearing cleaning apparatus contains a cage assembly (14), bottle (10), and cap (12). The cage assembly (14) includes rectangular-shaped vertical side arms (16) shaped so as to form one or more channels (26) in which one or more circular bearings (20) may be placed. The cage assembly (14) contains perforations (28) along the inner base surface (40) in order to facilitate solvent flow through the bearings (20) and the cage assembly (14). The cage assembly (14) also includes shoulders (30) at the bottom of the assembly, a closure mechanism (22) at the top of the assembly (14), and flanges (44) in order to prevent the bearings (20) from exiting the cage assembly (14) during cleaning.

13 Claims, 3 Drawing Sheets

BEARING CLEANING SYSTEM

This application claims benefit of Provisional application Ser. No. 60/021,708 filed Jul. 12, 1996.

TECHNICAL FIELD

This invention relates to bearing cleaning systems and more particularly to portable manually-operated bearing cleaning systems that are capable of cleaning one or more circular bearings with a solvent in an enclosed container.

BACKGROUND OF THE INVENTION

In-line skating has become an extremely popular sport in the United States and elsewhere. As the popularity of the sport has increased, demand for accessories for repairing and maintaining in-line skates has also increased. One common problem associated with frequent use of in-line skates is that dirt and other contaminants often get into the wheel bearings, leading to a decline in the overall performance of the wheels and ultimately the skates. Many in-line skaters prefer to take apart their skates and clean the wheel bearings themselves. This can be a time-consuming and cumbersome process however.

Many in-line skating enthusiasts desire a portable system by which they can quickly clean the bearings on their in-line skates so as to prevent damage to the bearings and increase overall in-line skate performance.

SUMMARY OF THE DISCLOSURE

The invention is the design of bearing cleaning system having a cage assembly and a bottle and cap. The cage assembly is designed such that it is capable of holding several bearing assemblies in a stacked arrangement. The cage assembly includes two identically-shaped vertical side arms. Each side arm has a base wall and two side walls bent at approximately ninety degree angles to the base so that it forms a channel into which the bearing assemblies can be placed. Each side wall has a top flange to retain the bearing assemblies inside the channel. The side arms contain perforations in the expected location of the bearing assemblies so that solvent can easily pass through the cage assembly during cleaning. The bottom of each side arm includes a shoulder which is used to prevent the bearing assemblies from sliding through the bottom of the cage assembly before, during, or after cleaning.

The side arms are connected to each other by several spaced-apart cross supports. The cross supports include male and female parts which meet to form the combination. In some embodiments of the invention, it is possible for these cross supports to be snap-fitted together.

The top of each side arm includes half a cylinder. When the side arms are correctly placed together, the half cylinders form a pole at the top of the assembly. A closure mechanism, used to prevent the bearing assemblies from exiting the cage assembly during cleaning, fits about the pole. In one embodiment of the invention, the closure mechanism includes a rotatable cap which can turn to either an opened or a closed position. In the preferred embodiment, of the rotatable cap is mounted about the pole and the pole includes cylinders of different sizes. Bearings of different bore sizes can be placed on these cylinders in order to be effectively dried via spinning the bearing assemblies around the cylinders.

In one embodiment of the invention, the rotatable cap comprises a single piece and is be snap-fitted on top of the pole formed by the two side arms to rotate within a formed groove in the pole.

The bottle used in the cleaning system is slightly higher than the cage assembly, and the bottle opening is slightly wider than the width of the cage assembly. In alternate embodiments of the invention, the cage assembly can be either fixedly or removeably attached to either the bottom of the bottle or the underside of the bottle cap.

The method for cleaning bearings in the assembly is as follows: the unclean bearings are placed in the channels in the cage assembly. After all of the bearings are in the channels. The closure mechanism at the top of cage is turned or rotated such that it partially closes the opening so that the bearings cannot escape the channel during cleaning. After the system bottle is filled with the appropriate type and amount of commercially available cleaning solvent, the cage assembly is placed inside the bottle. The cap is then placed on the bottle to prevent the solvent from leaking from the system.

Once the bottle is tightly closed, the user turns the bottle horizontal and thoroughly shakes the bottle for the appropriate amount of time. This motion causes the solvent to flow through the bearings inside the cage assembly, loosening and removing dirt and other particles from the bearings. When the bottle has been thoroughly shaken, the cap and cage assembly are removed from the bottle and the bearings are allowed to dry.

In another embodiment, an elongated member can be placed across the bottle opening. The cage assembly is placed atop the elongated member allowing the solvent to drain from the bearings and cage assembly back into the bottle. After the solvent has drained from the bearings, the closure mechanism on the cage assembly is turned or rotated in such a manner so that the cleaned bearings can be removed.

Although the cage assembly in the present invention is designed to hold circular bearings, it can be modified to hold other objects such as slot car motors for cleaning. For a slot car motor, a cage assembly includes a bracket with one or more circular holes at the top and side of the bracket. A bolt and wing nut can be used to secure the bracket to a supporting device through the holes on the side of the bracket. The supporting device, bent in an L-shape, has similar holes on one side through which the bolt passes. When connected, the bracket and supporting device forms a channel in which the motor would be placed. The top of the slot motor is secured by being fit in the top hole of the bracket.

BRIEF DESCRIPTION OF THE DRAWINGS

Reference now is made to the accompanying drawings in which.

DETAILED DESCRIPTION OF THE INVENTION

Figure 1:
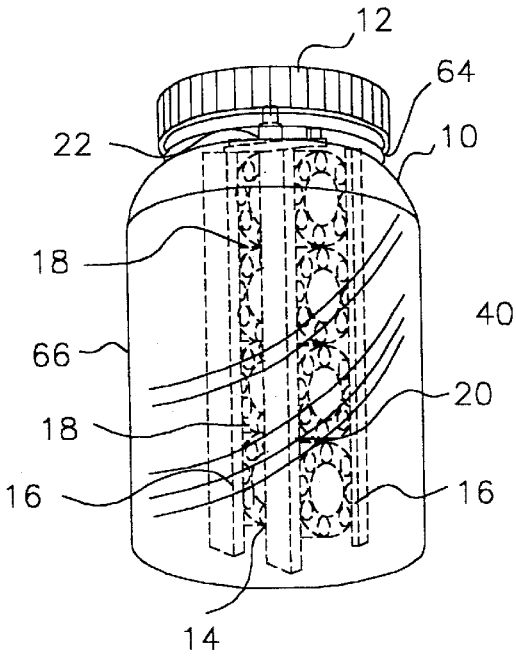
FIG. 1 is a perspective view of a bearing cleaning system including a cage assembly with bearings in place in two vertically stacked columns with each bearing in a vertical orientation.

Referring to the drawings, a bearing cleaning system contains a bottle 10, a cap 12, and a cage assembly 14 as shown in FIG. 1. In different embodiments of the invention, the cage assembly 14 can be fixedly or removably connected to the base of the bottle 10, fixedly or removably connected to the bottle cap 12, or independent of both the bottle 10 and bottle cap 12. In this embodiment, the cage assembly 14 is independent of both the bottle 10 and bottle cap 12 and has a height to about both the bottom of the bottle 10 and the cap 12 to prevent axial displacement during the cleaning process as later described.

The cage assembly 14 has two identical side arms 16 and multiple cross members 18 connecting the side arms together. Each cross member 18 is formed by joining a male component 19 and a female component 21 on the respective identical side arms 16. Each side arm 16 has a flat surface with multiple perforations 28 in order to facilitate solvent flow through the cage assembly.

Figure 2:
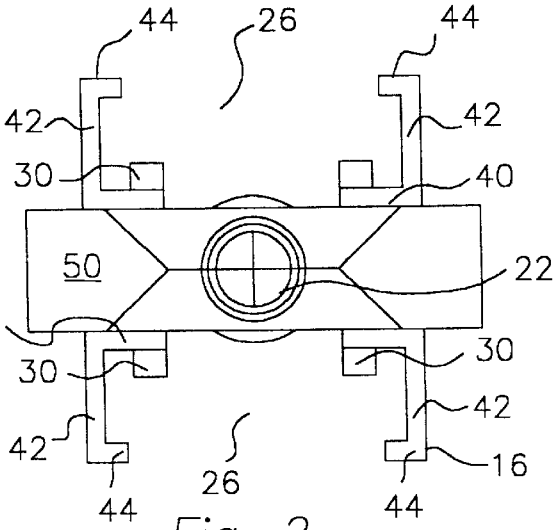
FIG. 2 is a top plan view of the cage assembly used in the apparatus with the closure mechanism shown in the open position.
Figure 7:
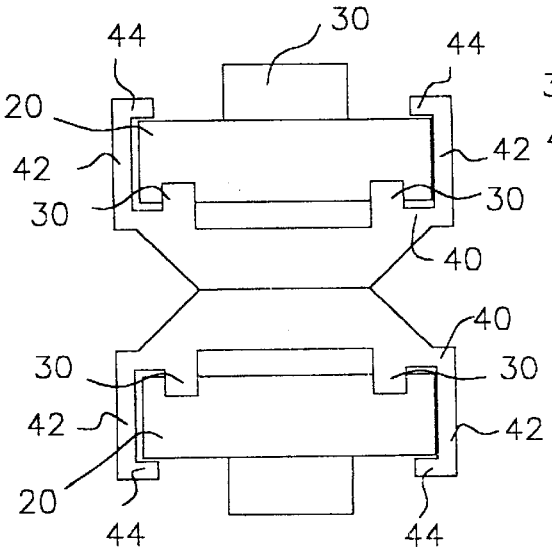
FIG. 7 is a bottom end view of the cage assembly with the closure mechanism in the closed position.

As shown in FIG. 2, the side arms 16 each have a base wall 40 and opposing side walls 42 bent at approximately ninety-degree angles from the base wall 40. The distal end of the side walls 42 have flanges 44 bent inwardly to prevent the bearings from laterally leaving the cage assembly 14. The combination of the base wall 40, side walls 42, and flanges 44 form channels 26 which are sized to receive the bearings 20 to be cleaned. When joined together, the side arms 16 join at the top 24 to form a pole 48. The lower ends of the side arms 16 contain shoulders 30 which prevent the bearings 20 from sliding through the bottom of the cage assembly 14 as shown in FIG. 7. In an alternate embodiment of the invention, the side arms 16 are flexible such that they hold the bearings 20 in position in two vertically stacked columns during cleaning.

Figure 3:
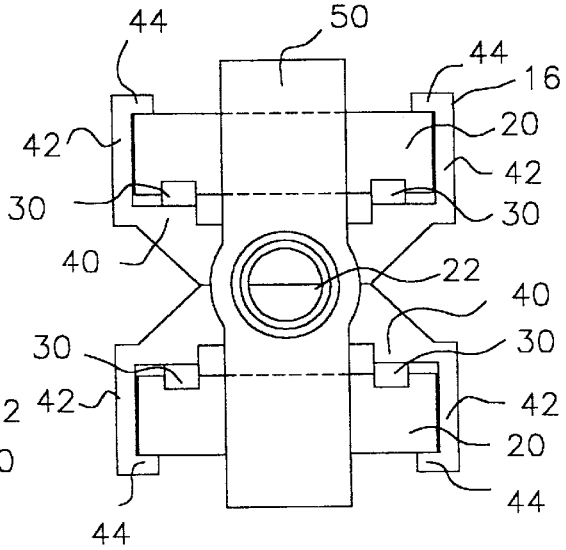
FIG. 3 is a top plan view of the cage assembly used in the apparatus with the closure mechanism shown in the closed position.
Figure 4:
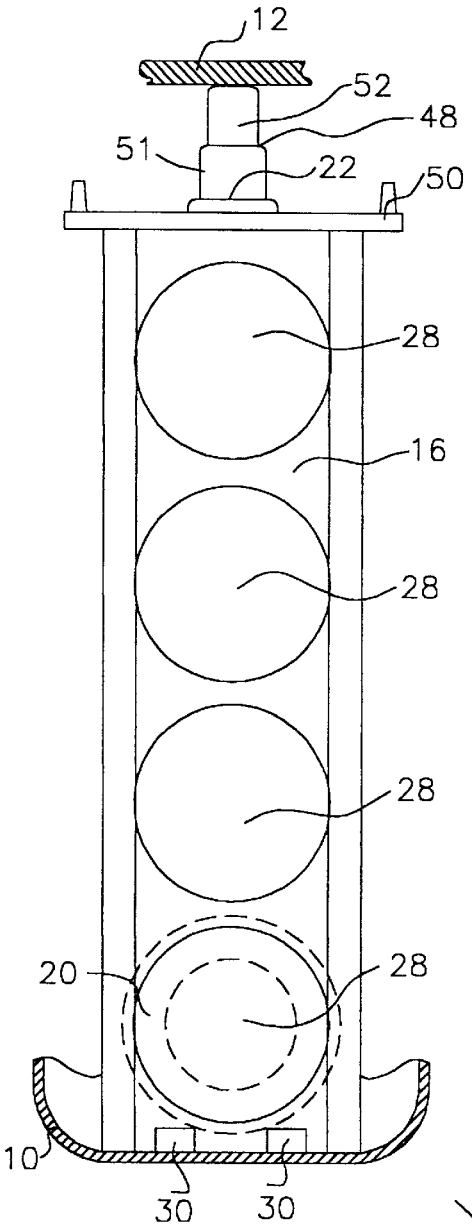
FIG. 4 is a side view of one embodiment of a cage assembly showing one bearing in place.
Figure 5:
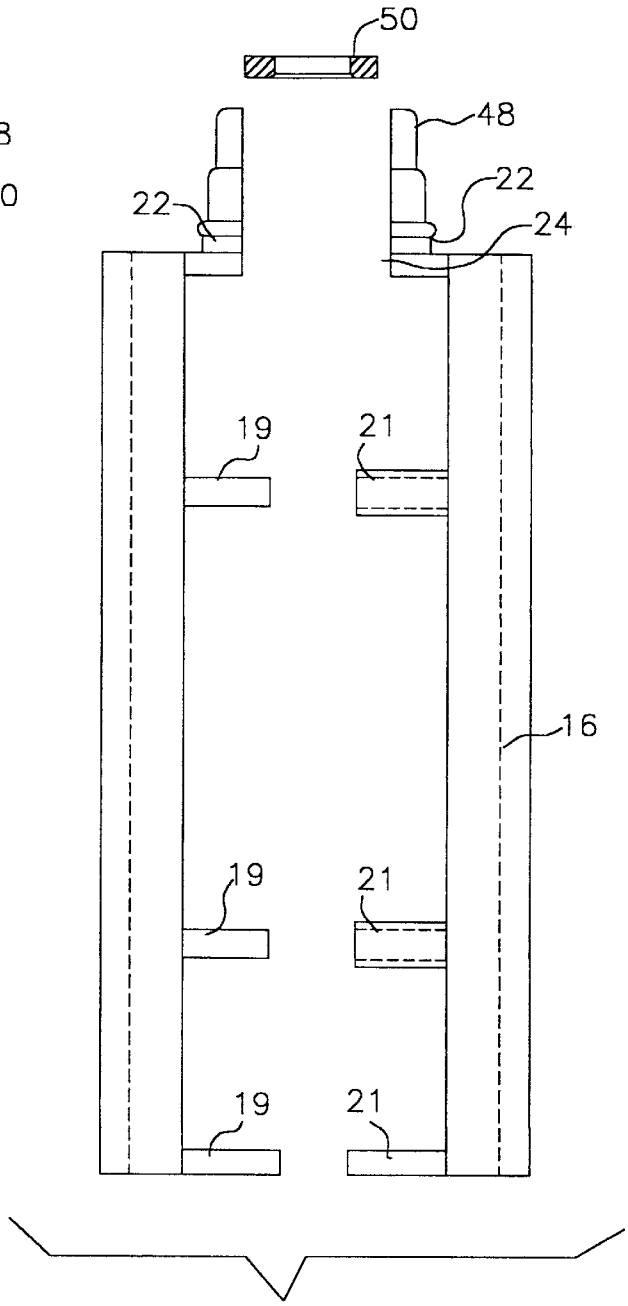
FIG. 5 is an exploded side view of the cage assembly of FIG. 3 where the left and right cross supports are clearly shown of the two identical side arms 16.
Figure 6:
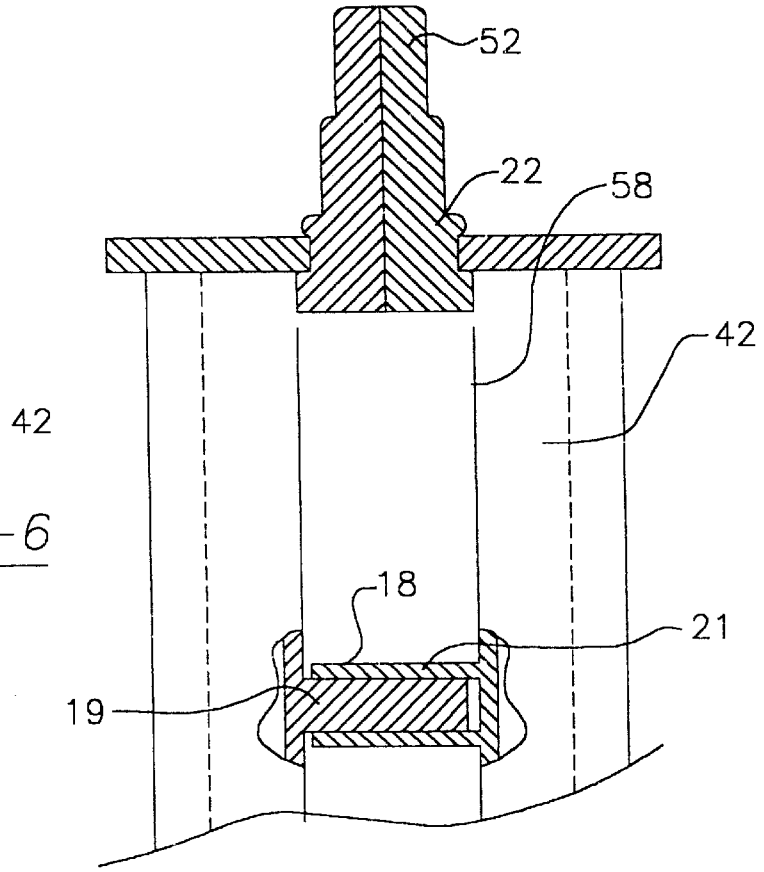
FIG. 6 is a fragmentary side view of the upper portion of the cage assembly with the closure mechanism shown in the closed position.

A closure mechanism 22 is placed upon the pole 48 in order to prevent the bearings 20 from exiting the cage assembly 14 during cleaning as shown in FIG. 3. The closure mechanism 22, in the form of a straight bar 50 mounted about pole 48 with a central cylinder 52 and a lower larger cylinder 51 as shown in FIG. 6, is capable of rotating between the positions shown in FIGS. 4 and 5 such the cage assembly 14 can be opened and closed by the user.

The operation of the invention is straightforward and simple. Before cleaning, the closure mechanism 22 is in the open position as shown in FIG. 2 to receive the circular bearings. One or more circular bearings 20 are placed into the channels formed by the bends in the side arms 16. After the closure mechanism 22 is turned such that the upper opening is blocked, the cage assembly 14 is placed into the bottle 10. Solvent is poured into the bottle 10 either before or after the cage assembly 14 is placed inside the bottle 10. The bearings can be completely submerged in solvent to soak. Solvent can then be poured off such that about one third of the bottle is filled with solvent in order to allow the solvent adequate room to vigorously circulate in the bottle during agitation. The cap 12 is then used to close the bottle 10. The user thoroughly shakes the bottle 10 in such a fashion horizontal that the solvent flows through the cage assembly 14 and removes unwanted particles from the bearings 20. A person can grip the bottle 10 such that it is longitudinal and the bottle is shaken vertically to direct solvent back and forth through the holes providing access to the bearing assemblies.

After cleaning, the cap 12 is removed from the bottle 10 and the bearings are dried in the ambient air after the cage assembly 14 is removed from the bottle 10. In an alternate embodiment of the invention, an elongated flat bar (not shown) can be placed across the opening of the bottle 10. The cage assembly 14 is placed atop the elongated flat bar and is supported thereby. Alternatively, the flat bar can extend between the side arms and abut a pair of the cross supports 18. Once the solvent has drained from the bearings 20 and cage assembly 14 into the bottle 10, the closure mechanism 22 is turned or rotated such that the bearings 20 may be removed from the cage assembly 14. A bearing depending on its bore size fits about cylinder 51 or about cylinder 52 and can be dried via spinning about the appropriate cylinder.

Figure 8:
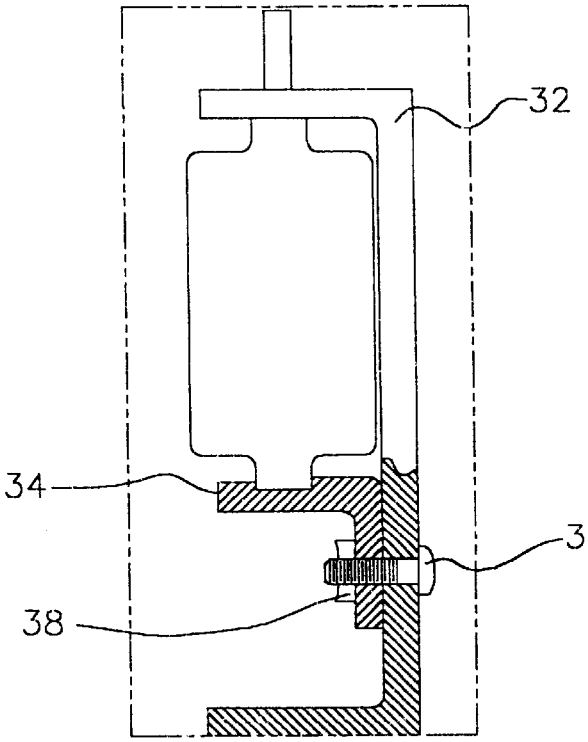
FIG. 8 is a side view of a cage assembly designed to hold a slot motor for cleaning.

In an alternate embodiment of the invention, the cage assembly 14 includes a primary bracket 32 and supporting device 34 as shown in FIG. 8. The primary bracket 32 is bent at each end and has one or more holes at both the top end and the side of the bracket 32. The supporting device 34 has an L-shape and has one or more holes one side. The bracket 32 is joined with the supporting device 34 with a bolt 36 and wing nut 38. When joined, the bracket 32 and supporting device 34 form a channel in which the slot motor 39 may be placed.

Other variations and modifications are possible without departing from the scope and spirit of the present invention as defined by the appended claims.

The embodiments in which an exclusive property or privilege is claimed are defined as follows:

1. A portable apparatus for manually cleaning one or more circular bearings in an appropriate solvent comprising:

a cage assembly that is designed to hold one or more bearing assemblies in a stacked arrangement comprising:

two vertical side arms interconnected by spaced-apart cross supports and each bent in such a manner as to create through which one or more circular bearings can be placed;

said side arms containing perforations along one side at the expected locations of the bearings in order to facilitate solvent flow through the bearings and cage assembly;

said side arms having a shoulder at the lower ends in order to prevent the bearings from falling through the cage assembly;

and a mechanism connected to the top of the side arms to prevent the bearings from leaving the cage assembly during cleaning;

a bottle with an opening sized to receive said cage assembly and a height slightly longer than the length of said cage assembly which holds the cage assembly in place while the bearings are cleaned by a solvent during agitation of the bottle; and a bottle cap which is used to seal the opening of the bottle once the cage assembly is placed inside.

2. The apparatus as described in claim 1 wherein the cage assembly is of a length such that it extends from the bottom of the bottle to the bottle cap.

3. The apparatus as described in claim 1 wherein said side arms of the cage assembly include a base wall and side walls; said side walls having flanges at the distal end of the side walls.

4. The apparatus as described in claim 1 wherein the side arms of the cage assembly are identically shaped and are connected by cross members which are formed by respective male and female components which fit into one another.

5. The apparatus as described in claim 1 wherein the vertical side arms join to form a pole at the upper end and the mechanism at the top of the cage assembly includes a rotatable cap which is mounted about the pole.

6. The rotatable cap described in claim 5 wherein the pole includes at least two cylinders of different sizes extending above the cap.

7. A bearing-holding device for use in a portable apparatus for manually cleaning one or more circular bearings, said bearing-holding device comprising:

a cage assembly having two vertical side arms interconnected by spaced-apart cross supports and each bent in such a manner as to create channels through which one or more circular bearings can be placed;

said side arms containing perforations along one side at the expected locations of the bearings in order to facilitate solvent flow through the bearings and cage assembly;

said side arms having a shoulder at the lower ends in order to prevent the bearings from falling through the cage assembly;

and a mechanism connected to the top of the side arms to prevent the bearings from leaving the cage assembly during cleaning.

8. The bearing-holding device described in claim 7 wherein said side arms include a base wall and side walls, said side walls having flanges at the distal end of the side walls.

9. The bearing-holding device described in claim 7 wherein the device includes two identically-shaped side arms and are connected by cross members which are formed by corresponding male and female components that fit into one another.

10. A portable apparatus for manually cleaning one or more circular bearings in a cleaning solvent comprising:

a container with a top opening, said container constructed to hold a liquid solvent;

a container cap for selectively closing said opening when installed on the container;

an assembly sized to fit through the opening of the container and extend from a bottom of the container to proximate the cap when installed on the container;

said assembly constructed to hold a plurality of bearing assemblies thereon for exposure to solvent during agitation of said container.

11. An apparatus as defined in claim 10 further comprising:

said assembly constructed to hold a plurality of bearings in a vertical stacked arrangement.

12. An apparatus as defined in claim 11 further comprising:

said assembly constructed to hold a plurality of bearings in at least two vertical stacked columns.

13. An apparatus as defined in claim 12 further comprising:

said assembly constructed to secure a plurality of bearings in place with each bearing in a vertical orientation.

* * * * *